US005868659A

United States Patent [19]

Slomski

[11] Patent Number: 5,868,659

[45] Date of Patent: Feb. 9, 1999

[54] METHOD OF FORMING A TWO-PIECE FUSED TOP LIFT CARRIER

[75] Inventor: Edward J. Slomski, Crystal Lake, Ill.

[73] Assignee: Illinois Tool Works Inc., Glenview, Ill.

[21] Appl. No.: 747,612

[22] Filed: Nov. 13, 1996

[51] Int. Cl.[6] ..... B65B 17/00; B65D 75/00

[52] U.S. Cl. ..... 493/374; 53/48.4; 53/398; 206/150; 206/162; 294/87.2

[58] Field of Search ..... 294/87.2, 87.28, 294/159; 53/48.4, 134.1, 398, 413; 206/141–143, 145, 150, 151, 162–165, 200, 427; 493/339, 352, 363, 374, 382

[56] References Cited

U.S. PATENT DOCUMENTS

| | | | |
|---|---|---|---|
| 3,016,136 | 1/1962 | Poupitch | 206/163 X |
| 3,038,602 | 6/1962 | Rapata . | |
| 3,186,544 | 6/1965 | Curry et al. | 206/162 |
| 3,383,827 | 5/1968 | Schaich . | |
| 3,700,276 | 10/1972 | Klygis | 294/87.2 |
| 3,822,012 | 7/1974 | Weaver | 294/87.2 X |
| 4,269,314 | 5/1981 | Barrash | 206/150 X |
| 5,115,910 | 5/1992 | Klygis et al. . | |
| 5,174,441 | 12/1992 | Marco . | |
| 5,193,673 | 3/1993 | Rathbone et al. . | |
| 5,265,718 | 11/1993 | Marco . | |
| 5,437,364 | 8/1995 | Broskow . | |
| 5,487,465 | 1/1996 | Broskow . | |
| 5,593,026 | 1/1997 | Broskow | 294/87.2 X |

FOREIGN PATENT DOCUMENTS

| | | | |
|---|---|---|---|
| 2163344 | 2/1986 | United Kingdom | 294/87.2 |

*Primary Examiner*—Johnny D. Cherry
*Attorney, Agent, or Firm*—Trexler, Bushnell, Giangiorgi & Blackstone, Ltd.

[57] ABSTRACT

A novel top lift carrier and a novel method of forming same are disclosed herein. The carrier is used to carry a plurality of containers, such as cans, bottles and the like. The carrier is formed from a single ply, plastic handle portion which has a plurality of tabs along an edge thereof and a planar, plastic container engaging portion which has a plurality of apertures therethrough that are provided in rows. Each aperture carries one of the containers. The handle portion and the container engaging portion are formed separately and may be made of dissimilar materials. To form the completed carrier, the tabs are fused or welded to the container engaging portion between the rows of apertures. In a first embodiment, the container engaging portion is provided with a plurality of spaced slots between the rows of apertures. The tabs on the handle portion are respectively inserted through the slots and fused or welded to an underside of the container engaging portion to form a strong, peel resistant weld. When the carrier is carried with containers therein, the weld is placed in shear. In a second embodiment, the slots are eliminated and the tabs are fused or welded directly to the upper surface of the container engaging portion. This embodiment is preferably used for lighter weight items in which peel forces do not need to be substantially eliminated.

6 Claims, 3 Drawing Sheets

METHOD OF FORMING A TWO-PIECE FUSED TOP LIFT CARRIER

BACKGROUND OF THE INVENTION

This invention is generally directed to a plastic top lift carrier for carrying containers such as bottles, cans and the like. More particularly, the invention contemplates a plastic carrier which has a single ply handle portion that is formed separately from a planar container engaging portion. The handle portion and the container engaging portion are fused or welded together after formation of the portions.

U.S. Pat. No. 5,487,465, which is commonly owned by the assignee herein, discloses a plastic carrier for carrying containers, such as cans, bottles and the like. The carrier is formed from two webs of plastic material juxtaposed over one another and stamping the handle portion and the container engaging portion out of the web simultaneously. The webs are fused or welded across the juncture between the handle portion and the container engaging portion, such as by heat sealing, to form a weld. The resulting handle portion has a double thickness and the container engaging portions freely depend from the handle portion at the weld.

While this carrier construction performs well in the carrying of containers, several disadvantages result. Because of the construction, the handle portion is of a double thickness which wastes material. In addition, the handle portion and the container engaging portion must be formed from the same material and the carrier portion must be symmetrical about its centerline.

The present invention provides a novel carrier which provides a container engaging portion which is formed separately of the handle portion and are thereafter joined together prior to being assembled with the containers. This overcomes the disadvantages of the prior art. Several new advantages are also presented by the carrier disclosed herein.

OBJECTS AND SUMMARY OF THE INVENTION

An object of the present invention is to provide a top lift plastic carrier which is formed from a handle portion and a container engaging portion that are separately formed and thereafter joined together.

Another object of the present invention is to provide a top lift plastic carrier which has a handle portion being of a single ply of plastic material.

Yet another object of the present invention is to provide a plastic carrier for which different styles of the handle portion may be readily provided.

A further object of the present invention is to provide a plastic carrier which has a container engaging portion that is not identical on both sides of the carrier.

A specific object of the present invention is to provide a carrier that has a weld between the container engaging portion and the handle portion which is placed in shear when carried with containers therein and resists peel forces.

Briefly, and in accordance with the foregoing, the present invention discloses a novel top lift carrier and a novel method of forming same. The carrier is used to carry a plurality of containers, such as cans, bottles and the like.

The carrier is formed from a single ply, plastic handle portion which has a plurality of tab portions along an edge thereof and a planar, plastic container engaging portion which has a plurality of apertures that are provided in rows. Each aperture carries one of the containers. The handle portion and the container engaging portion are formed separately and can be made of dissimilar materials. To form the completed carrier, the tab portions are fused or welded to the container engaging portion between the rows of apertures by suitable means, such as by heat sealing or by using heat or pressure sensitive adhesive between the tab portions and the container engaging portion.

In a first embodiment of the carrier, the container engaging portion is provided with a plurality of spaced slots between the rows of apertures. The tab portions on the handle portion are respectively inserted through the slots and fused or welded to an underside of the container engaging portion to form a strong, peel resistant weld. When the carrier is carried with containers therein, the weld is placed in shear instead of in peel.

In a second embodiment of the carrier, the slots in the container engaging portion are eliminated and the tab portions are fused or welded directly to the upper surface of the container engaging portion. This embodiment of the carrier is preferably used to carry lighter items for which peel forces do not have to be substantially eliminated.

To form the carrier, at least one roll of plastic material is provided. The handle portion and the container engaging portion are stamped separately from each other in a continuous manner such that adjacent handle portions are connected to each other and adjacent container engaging portions are connected to each other. The handle portion may be stamped from one roll of material at one time and place and the container engaging portion stamped from another roll of material at another time and place, if desired. Therefore, it is not necessary that the same plastic material is used to form the handle portion and the container engaging portion. For example, the handle portion may be formed from a heavier weight or thicker plastic material than that used for the container engaging portion. When the handle portion is stamped, it is formed from a single ply of plastic material and has a plurality of tab portions formed on an edge thereof. When the container engaging portion is stamped, it is formed from a planar sheet of material and has a plurality of apertures provided in rows therethrough.

The handle portion and the container engaging portion are overlapped such that the tab portions are positioned between the rows of apertures. The tab portions are fused or welded to the container engaging portion between the rows of apertures by suitable means to form the completed carrier.

The completed carriers are then wound into a roll on a reel. To use the carrier, one of the carriers is severed from the other carriers on the roll by suitable means.

If the first embodiment of the carrier is being formed, during the step of stamping the container engaging portion, a plurality of spaced slots are stamped between the rows of apertures. Further, during the step of overlapping the handle portion and the container engaging portion, the tab portions are inserted into and through the slots. When the tab portions are fused or welded to the container engaging portion, the tab portions are fused or welded to an underside of the container engaging portion to form a strong, peel resistant weld, with the remainder of the handle portion being above the container engaging portion. When containers are placed in the carrier and the package is carried, the weld is placed in shear, not in peel.

If the second embodiment of the carrier is being formed, the slots through the container engaging portion are eliminated. Instead, the tab portions are fused or welded to a top surface of the container engaging portion between the rows of apertures. This embodiment of the carrier is preferably used for lighter weight items for which peel forces do not need to be substantially eliminated.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which:

FIG. 1 is a perspective view of a top lift carrier which incorporates the features of a first embodiment of the invention shown surrounding a plurality of containers, such as cans or the like;

DETAILED DESCRIPTION OF THE PREFERRED EMBODIMENT

Figure 1:
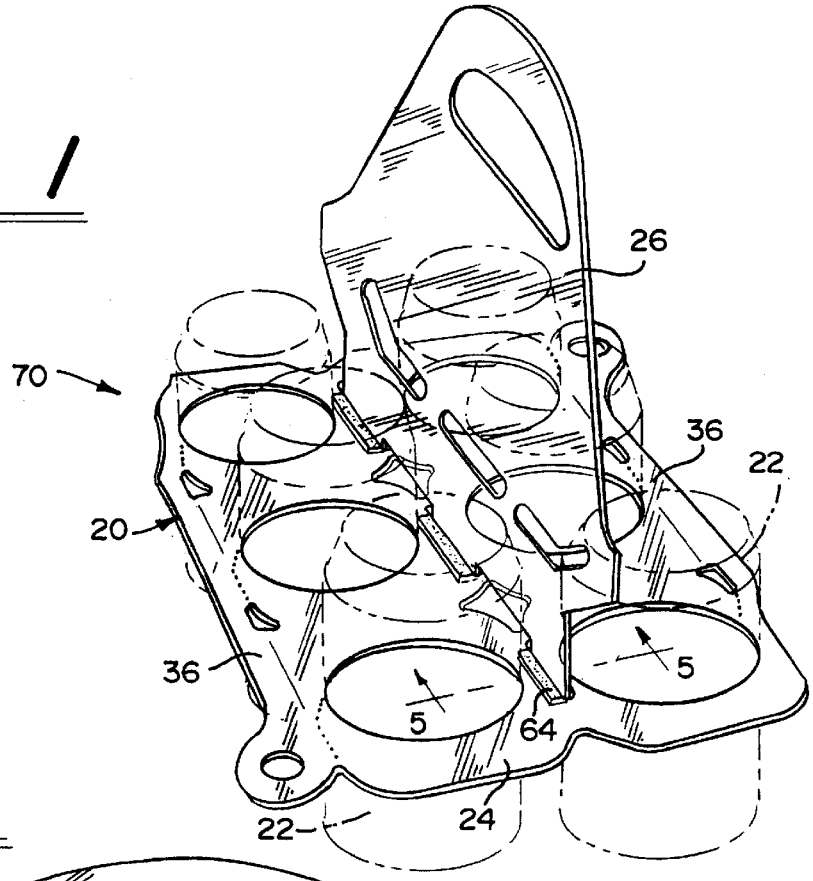
Figure 2:
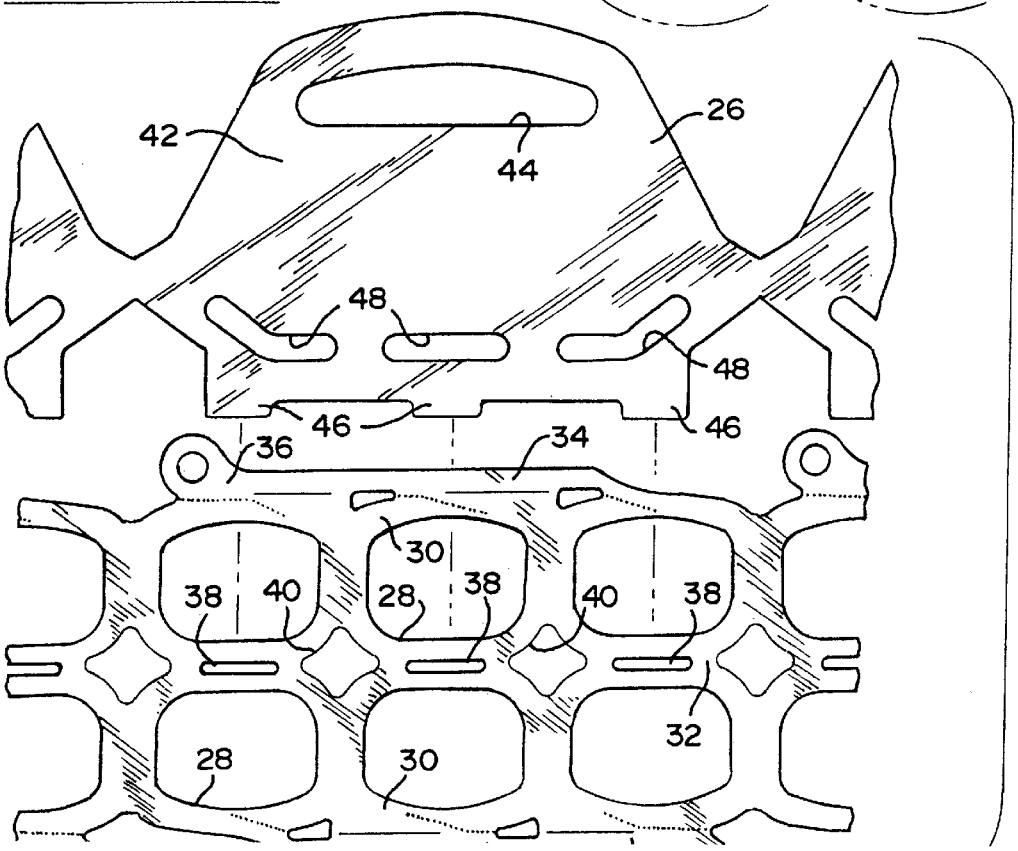
FIG. 2 is a top plan view of the top lift carrier prior to being assembled.
Figure 3:
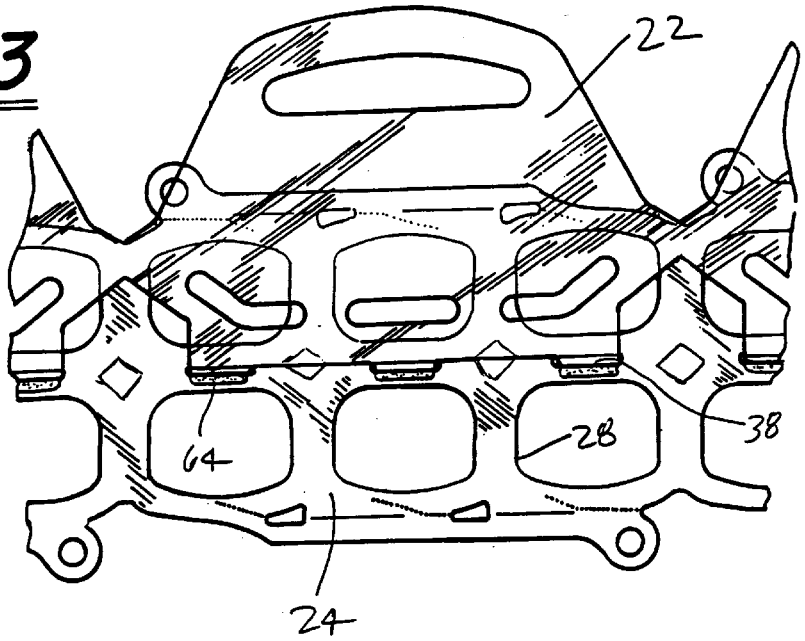
FIG. 3 is a top plan view of the top lift carrier after assembly.

While the invention may be susceptible to embodiment in different forms, there is shown in the drawings, and herein will be described in detail, specific embodiments with the understanding that the present disclosure is to be considered an exemplification of the principles of the invention, and is not intended to limit the invention to that as illustrated and described herein.

In FIG. 1, a first, preferred embodiment of a top lift carrier 20 which incorporates features of the present invention is shown. The carrier 20 is used for carrying containers 22, such as cans, bottles and the like.

The carrier 20 is formed from a container engaging portion 24 and a handle portion 26 which are manufactured separately from each other by stamping each out of a planar sheet of material and are joined together to form the completed carrier 20, as described more fully herein. The container engaging portion 24 and the handle portion 26 may be, and are preferably, made of two materials which are not identical to each other. For example, a heavier weight or thicker plastic material can be used for the handle portion 26 while a lighter weight or thinner plastic material or otherwise different material than the handle portion 26 is used for the container engaging portion 24. Alternatively, the container engaging portion 24 and the handle portion 26 may be made of the same material. The construction of the novel carrier 20 of the present invention permits separate sheets of material to be stamped individually to respectively form the container engaging portion 24 and the handle portion 26. This permits the handle portion 26 to be pre-printed on both sides and also permits the design of the carrier 20 to have features that are not necessarily identical on each side of the centerline of the top lift carrier 20.

The container engaging portion 24 is made from a planar blank of suitable flexible, resilient, stretchable material, such as plastic, and has a pair of rows of apertures 28 stamped therein and defined by annular bands 30 for securely holding therein the containers 22. For example, as shown in FIG. 1, the containers 22 are a plurality of typical beverage cans which are securely held within the apertures 28 in the container engaging portion 24 by the resiliently stretched bands 30. Preferably, the container engaging portion 24 is made of a low density polyethylene so that the container engaging portion 24 can be stretched over the containers 22 and conform to the side walls of the containers 22. The carrier 20 may be applied to the containers 22 by known means, for example, by the machines disclosed in U.S. Pat. Nos. 4,250,682 or 3,204,386. The container engaging portion 24 has a middle section 32 between the rows of apertures 28 and outer margins 34 on the opposite sides of the rows of apertures 28.

A plurality of spaced slots 38 each having a predetermined width are provided in the middle section 32 of the container engaging portion 24 and are generally provided between adjacent apertures 28 on each side of the portion 24. In addition, a plurality of generally diamond-shaped cutouts 40 are provided in the middle section 32 of the container engaging portion 24.

Each outer margin 34 has a zipper strip 36 thereon which may be formed in accordance with, and is fully disclosed, in co-pending U.S. patent application Ser. No. 08/608,522, now U.S. Pat. No. 5,642,808 which is commonly owned by the assignee herein and which disclosure is herein incorporated by reference. Because the container engaging portion 24 is stamped out of a planar blank of material separately from the handle portion 26, the carrier 20 of the present invention presents an improvement to the carrier disclosed in co-pending Ser. No. 08/608,522 because the design of the carrier 20 of the present invention permits the design of the carrier 20 to have features that are not necessarily identical on each side of the centerline of the carrier 20 as is necessary in co-pending Ser. No. 08/608,522. For example, the design of this carrier 20 permits the zipper strip 36 to be designed to be opened from either the same direction on both sides of the carrier 20 or different directions on each side of the carrier 20. This carrier 20 also permits a UPC flap (not shown) to be on one outer margin 34 of the container engaging portion 24 and not on the other outer margin thereof.

The handle portion 26 is made of a planar blank of suitable flexible, resilient, stretchable material, such as plastic, preferably low density polyethylene. The handle portion 26 has a body portion 42 having an aperture 44 provided through an upper portion of the body portion 42 proximate one edge of the body portion 42 so that a user's hand can be inserted through the aperture 44 to grasp the handle portion 26. A plurality of spaced tab portions 46 are provided on the opposite edge of the body portion 42 and protrude from the remainder of the body portion 42. The tab portions 46 are spaced apart from each other approximately the same distance that the slots 38 provided through the container engaging portion 24 are spaced and have a predetermined width which is approximately the same as the width of the slots 38. In addition, a plurality of openings 48 are formed through the body portion 42 proximate to the edge on which the tab portions 46 are provided.

To form the completed carrier 20, each tab portion 46 on the handle portion 26 is inserted into and through one of the spaced slots 38 in the container engaging portion 24. Thereafter, the tab portions 46 are fused or welded to the underside of the container engaging portion 24 by suitable means.

Figure 4:
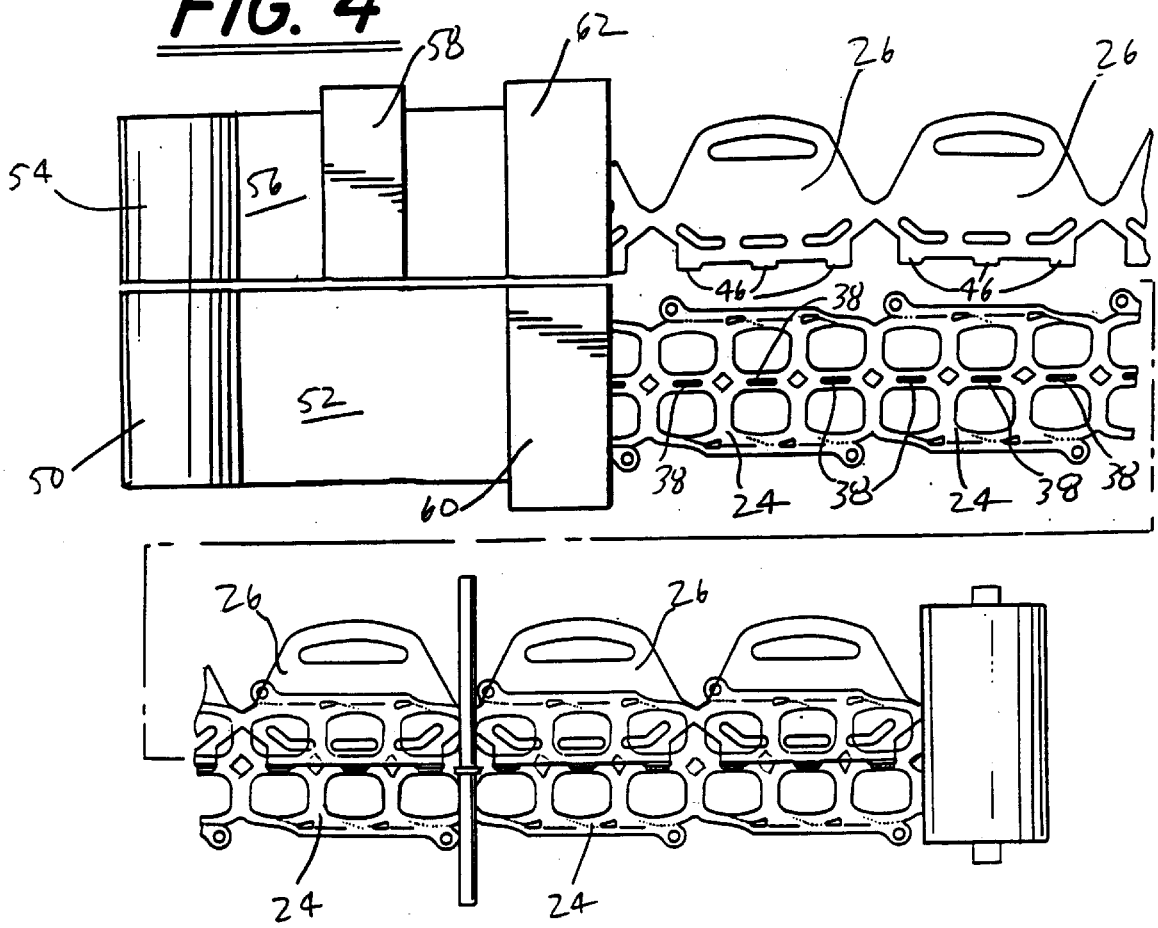
FIG. 4 is a schematic view of the steps used to form the top lift carrier of the present invention.
Figure 5:
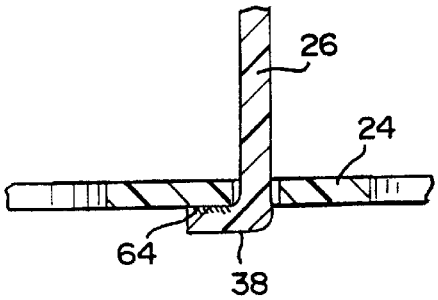
FIG. 5 is a cross-sectional view of the top lift carrier along line 5—5 in FIG. 1.

Now that the specifics of the carrier 20 have been described, a general description of the method for making the carrier 20 is described. The method for making the carrier 20 is schematically illustrated in FIG. 4 in a simplified form.

The carrier 20 is formed in a continuous method. A roll 50 of plastic material provides a first web 52 which is used to form the handle portion 26 and a roll 54 of plastic material provides a second web 56 which is used to form the container engaging portion 24. These webs 52, 54 may be the same material or different materials. The webs 52, 54 may be the same color or dissimilar colors such that the resulting carrier 20 is natural, tinted or pigmented.

Initially, the web of material 54 which is used to form the handle portion 26 may be printed on by a suitable printing means 58. The handle portion 26 can be printed on one side or on both sides thereof in registration. If desired, a suitable printing means can be provided to print on the container engaging portion 24, for example to form a bar code on the UPC flap (not shown).

Each web 52, 56 is then punched separately by a punch press die 60, 62 of known construction, to form separate continuous strips of container engaging portions 24 and handle portions 26. The punch press die 60 forms all of the apertures 28, the zipper strip features and the slots 38 through the middle section 32 of the container engaging portion 24. Each container engaging portion 24 is integrally connected to the adjacent container engaging portion at the ends thereof. The punch press die 62 forms the tab portions 46 and all of the apertures and openings 44, 48 in the handle portion 26. Each handle portion 26 is integrally connected to the adjacent handle portion at the ends thereof.

The separate punching of the container engaging portion 24 and the handle portion 26 allows for a unique container engaging portion 24 and handle portion 26. The handle portion 26 can be readily changed to accommodate unique customer designs while using the container engaging portion 24, or a variation of the container engaging portion 24, disclosed herein. Smaller runs of the handle portion 26 can be run on less expensive tooling in a rotary, whereas the container engaging portion 24 can be run on a punch press die at three or four across. In addition, any combination of UPC flaps or opening features can be designed into the container engaging portion 24.

Thereafter, each handle portion 26 is moved by suitable means to join with the respective container engaging portion 24 by inserting the tab portions 46 into and through the slots 38 between the rows of apertures 28 such that the tab portions 46 are beneath the container engaging portion 24 and the remainder of the handle portion 26 is generally above the container engaging portion 24. During this process, the handle portions 26 and container engaging portions 24 remain flattened against each other.

Next, the handle portion 26 and the container engaging portion 24 are joined together along the middle section 32 of the container engaging portion 24 such that the tab portions 46 are fused or welded to the underside of the container engaging portion 24 to form a weld 64 between the tab portions 46 and the container engaging portion 24. The joining is effected by suitable means, such as by heat sealing using a heated roller 66. It should also be recognized that in some cases, a strip of heat sensitive or pressure sensitive adhesive may be inserted at desired locations between the container engaging portion 24 and the handle portion 26 to secure the tab portions 46 to the underside of the container engaging portion 24.

The continuous web of completed carriers 20 are then rolled into a roll 68 on a reel or otherwise appropriately stored until they are to be applied to containers by known methods. The structure and process of this invention thus provides degrees of manufacturing flexibility to produce integral carriers having features not capable of being created using existing technology.

It is to be understood that variations on the method for forming the carrier 20 may be performed. For example, the printing on the handle portion 26 may be done after the handle portion has been stamped by the punch press die 62. If the same material is being used to form both of the container engaging portion 24 and the handle portion 26, the same punch press die can be used to form both. In addition, the strip of container engaging portions 24 and the strip of handle portions 26 may be separately wound into rolls and then only assembled together prior to use.

To use the carrier 20 to carry containers 22 and form a package 70 as shown in FIG. 1, an individual carrier 20 is separated from the roll 68 by suitable means. The carrier 20 is then stretched over the containers 22 using known means.

To carry the package 70, the handle portion 26 is pivoted upwardly so as to extend upwardly between the rows of containers 22 and is generally perpendicular to the container engaging portion 24 of the carrier 20. The fusing or welding of the tab portions 46 on the underside of the container engaging portion 24 permits the weld 64 to be in shear and not in peel, thereby forming a stronger bond between the handle portion 26 and the container engaging portion 24.

Because the container engaging portion 24 and the handle portion 26 are formed separately and may be formed from dissimilar materials or be of dissimilar thicknesses, the material used for the container engaging portion 24 and the handle portion 26 can be optimized. For example, the handle portion 24 may be formed from a stronger plastic material than what is used to form the container engaging portion 26 so that the handle portion 26 will not tear from the weight of the containers 22. The single ply handle portion 26 allows for a material cost savings over double ply handles provided in prior art carrier handles.

Figure 6:
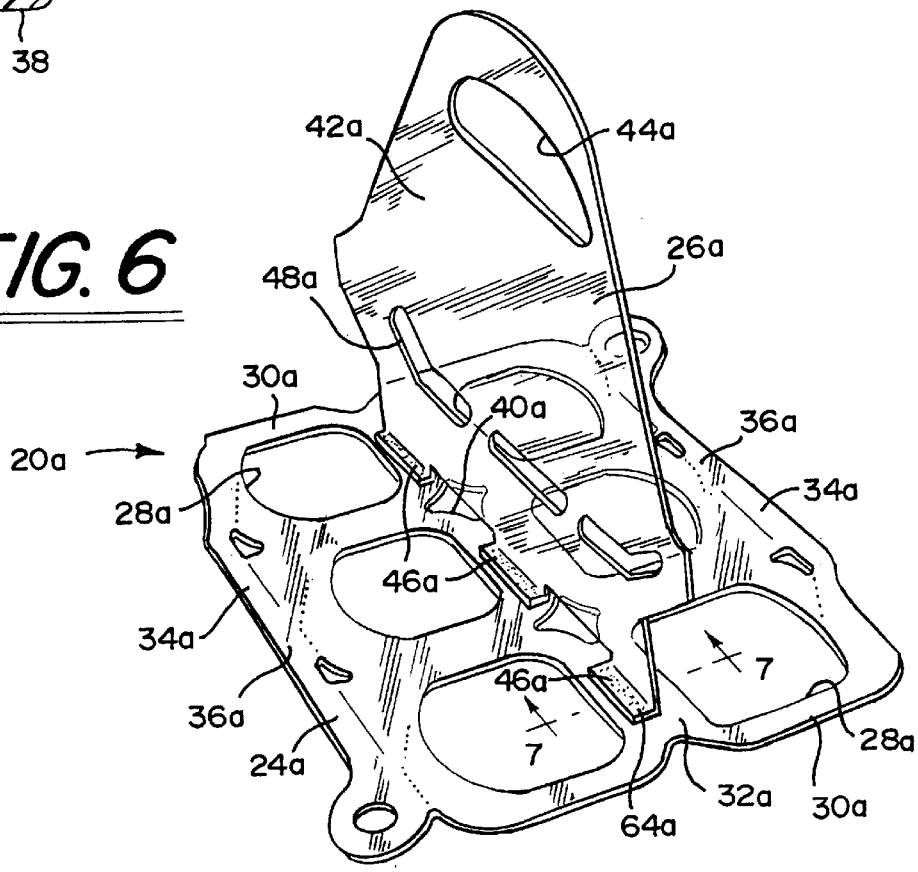
FIG. 6 is a perspective view of a top lift carrier which incorporates the features of a second embodiment of the invention.

The second embodiment of the carrier 20*a*, as shown in FIG. 6, is identical in construction to the first embodiment of the carrier 20 shown in FIG. 1 and provides all of the same advantages as described with respect to the first embodiment, except for the differences noted hereinbelow. The components of the carrier 20*a* which are identical to the carrier 20 are identified with the same numerals but with the suffix "a" after the reference numeral.

Figure 7:
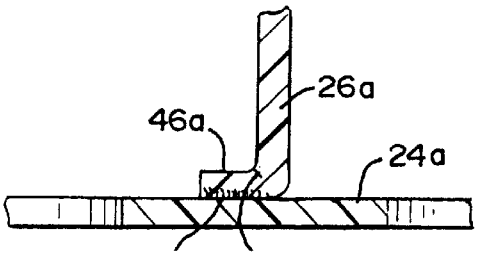
FIG. 7 is a cross-sectional view of the top lift carrier along line 7—7 in FIG. 6.

In this embodiment of the carrier 20*a*, the slots 38 through the middle section of the container engaging portion provided in the first embodiment of the carrier 20 have been eliminated. Instead, the tab portions 46*a* are fused or welded directly to the top surface of the container engaging portion 24*a* along the middle section 32*a* thereof to form a weld 64*a*, see FIG. 7, at the same positions that the slots would have been provided. This carrier 20*a* is preferably used to carry lighter items in which peel forces do not need to be substantially eliminated.

To carry the package, the handle portion 26 is pivoted upwardly so as to extend upwardly between the rows of containers 22 and is generally perpendicular to the container engaging portion 24*a* of the carrier 20*a*. Each tab portion 46*a* may be provided with a score line 72 at the juncture between the respective tab portion 46*a* and the remainder of the handle portion 26*a* to provide a crease, thereby aiding the handle portion 26*a* to move upwardly.

The method of forming the carriers 20*a* is identical to that described with respect to the first embodiment of the carrier

20 as shown in FIG. 4, except for the differences noted hereinbelow. When the container engaging portion 24*a* is punched by the punch press die 60, the portion 24*a* is identical to that of the first embodiment except that the slots 38 provided in the first embodiment are not formed. Thereafter, when each handle portion 26*a* is moved by suitable means to join with the respective container engaging portion 24*a*, the tab portions 46*a* are laid over the middle section 32*a* of the container engaging portion 24*a* between the rows of apertures 28*a* such that the tab portions 46*a* are on top of the container engaging portion 24*a*. During this process, the handle portions 26*a* and container engaging portions 24*a* remain flattened against each other. Finally, when the tab portions 46*a* of the handle portion 26*a* are fused or welded to the container engaging portion 24*a* along the middle section 32*a* thereof, the tab portions 46*a* are fused or welded on top of the container engaging portion 24*a* to form a weld 64*a* between the tab portions 46*a* and the container engaging portion 24*a*.

While preferred embodiments of the present invention are shown and described, it is envisioned that those skilled in the art may devise various modifications of the present invention without departing from the spirit and scope of the appended claims.

The invention claimed is:

1. A method of continuously forming a plurality of carriers, each said carrier for use in carrying a plurality of containers, said method comprising the steps of:

providing at least one continuous web of plastic material;

forming a plurality of handle portions out of said continuous web of plastic material to form a continuous web of handle portions, each said handle portion having a plurality of tab portions on an edge thereof;

forming a plurality of container engaging portions out of said continuous web of plastic material to form a continuous web of container engaging portions, each said container engaging portion having a plurality of apertures in rows thereon such that said container engaging portions are separate from said handle portions;

aligning said continuous web of handle portions and said continuous web of container engaging portions and overlapping a portion of said continuous web of handle portions onto said continuous web of container engaging portions such that said tab portions of each said handle portion are positioned between said rows of apertures of respective container engaging portions; and fusing said tab portions of each said handle portion to respective container engaging portions between said rows of apertures to form the completed carriers.

2. A method as defined in claim 1, further including the step of collecting said completed carriers onto a reel.

3. A method as defined in claim 1, wherein during said step of forming said container engaging portion, a plurality of spaced slots are formed between said rows of apertures, and wherein during said step of aligning said continuous web of handle portions and said continuous web of container engaging portions and overlapping said continuous web of handle portions onto said continuous web of container engaging portions, said tab portions on each said handle portion are inserted through said slots in the respective container engaging portion such that said tab portions are positioned between said rows of apertures and are thereafter fused to an underside of said respective container engaging portion with the remainder of said handle portion being substantially above said respective container engaging portion during said step of fusing said tab portions to said respective container engaging portion.

4. A method as defined in claim 1, wherein during said step of fusing said tab portions to said container engaging portion between said rows of apertures, said tab portions are fused to a top surface of said container engaging portion.

5. A method as defined in claim 1, wherein during said step of fusing said tab portions to said respective container engaging portion, a weld is formed, said weld being formed by heat sealing said tab portions to said respective container engaging portion.

6. A method as defined in claim 1, wherein during said step of fusing said tab portions to said respective container engaging portion, said tab portions are fused to said container engaging portion by adhesive.

* * * * *